US009328979B2

(12) United States Patent
Brumfield

(10) Patent No.: US 9,328,979 B2
(45) Date of Patent: May 3, 2016

(54) HEAT EXCHANGER CLEANING TOOL WITH THREE AXIS CONTROL

(71) Applicant: Veolia ES Industrial Services, Inc., League City, TX (US)

(72) Inventor: Michael Kenneth Brumfield, Bridge City, TX (US)

(73) Assignee: Veolia ES Industrial Services, Inc., League City, TX (US)

( * ) Notice: Subject to any disclaimer, the term of this patent is extended or adjusted under 35 U.S.C. 154(b) by 202 days.

(21) Appl. No.: 13/954,220

(22) Filed: Jul. 30, 2013

(65) Prior Publication Data

US 2015/0034128 A1 Feb. 5, 2015

(51) Int. Cl.

| | |
|---|---|
| ***B08B 9/04*** | (2006.01) |
| ***B08B 9/043*** | (2006.01) |
| ***F28G 1/16*** | (2006.01) |
| ***F28G 15/04*** | (2006.01) |
| ***F28G 15/02*** | (2006.01) |

(52) U.S. Cl.

CPC . *F28G 1/163* (2013.01); *B08B 9/04* (2013.01); *B08B 9/043* (2013.01); *B08B 9/0433* (2013.01); *F28G 15/02* (2013.01); *F28G 15/04* (2013.01)

(58) Field of Classification Search

CPC ..... B08B 9/0321; B08B 9/04; B08B 9/027; B08B 9/043; B08B 9/0433; F28G 1/63; F28G 15/04; F28G 15/02

USPC ..... 134/8, 22.1, 22.11, 22.12, 22.18, 24, 134/166 R

See application file for complete search history.

(56) References Cited

U.S. PATENT DOCUMENTS

| | | | | |
|---|---|---|---|---|
| 3,389,713 | A | 6/1968 | Pittman | |
| 3,817,262 | A | 6/1974 | Caradeur et al. | |
| 4,399,773 | A | 8/1983 | Schwade et al. | |
| 4,716,611 | A * | 1/1988 | Barry | 15/3.51 |
| 4,856,545 | A | 8/1989 | Krajicek et al. | |
| 5,129,455 | A | 7/1992 | Boisture | |
| 5,377,913 | A | 1/1995 | Van Der Woude | |
| 5,735,964 | A | 4/1998 | Amuny | |
| 5,838,882 | A | 11/1998 | Gan et al. | |
| 8,083,865 | B2 | 12/2011 | Geppert et al. | |
| 9,074,830 | B2 * | 7/2015 | Moll et al. | |
| 2011/0155174 | A1 * | 6/2011 | Moll et al. | 134/8 |
| 2011/0220700 | A1 | 9/2011 | Zink | |
| 2012/0103368 | A1 | 5/2012 | Gromes, Sr. | |

* cited by examiner

*Primary Examiner* — Saeed T Chaudhry
(74) *Attorney, Agent, or Firm* — Bracewell LLP

(57) ABSTRACT

A tool for cleaning a heat exchanger that includes a lance, and an articulated arm fixedly attached to the heat exchanger at a first end, and associated with the lance at a second end. The articulated arm has at least two joints so that the articulated arm can move the lance along two axes in a plane substantially parallel to the tube face of the heat exchanger. The tool further includes a lance transport mechanism attached to the second end of the articulated arm that moves toward and away from the tube face of the heat exchanger in a direction substantially perpendicular to the tube face, the lance transport mechanism attached to the lance so that the lance moves toward and away from the tube face along with the lance transport mechanism.

15 Claims, 5 Drawing Sheets

HEAT EXCHANGER CLEANING TOOL WITH THREE AXIS CONTROL

BACKGROUND OF THE INVENTION

1. Field of the Invention

The present invention relates to a tool for cleaning tubes in heat exchangers, and in particular to a tool that moves a tube cleaning lance along three axes into alignment with tubes to be cleaned, and to directs or guides the lance into the tubes to be cleaned.

2. Description of the Related Art

In a number of industrial facilities, surface condensers, or heat exchangers, are used to convert steam to liquid water. These heat exchangers require the circulation of large quantities of water through tubes within the heat exchangers. The result of this circulation is that impurities in the water foul the tubes over time.

Depending on the extent of the fouling, the impact on the efficiency and performance of the heat exchangers can be dramatic. As fouling builds up, the contaminates insulate the tubes, thereby diminishing the heat transfer between tubes within the heat exchanger. In order to control fouling and maintain the efficiency of industrial heat exchangers, it is therefore necessary to periodically clean the tubes in the heat exchanger.

SUMMARY OF THE INVENTION

Briefly, the present invention provides a tool for cleaning a heat exchanger having tubes and a tube face. The tool includes a lance, and an articulated arm fixedly attached to the heat exchanger at a first end, and associated with the lance at a second end. The articulated arm has at least two joints so that the articulated arm can move the lance along two axes in a plane substantially parallel to the tube face of the heat exchanger. The tool also includes a lance transport mechanism attached to the second end of the articulated arm that moves toward and away from the tube face of the heat exchanger in a direction substantially perpendicular the tube face. The lance transport mechanism is attached to the lance so that the lance moves toward and away from the tube face along with the lance transport mechanism.

The present invention further provides a heat exchanger cleaning apparatus that includes an articulated arm assembly having a lance attached thereto. The articulated arm assembly has a base fixedly attached to a heat exchanger having a tubing face, a primary arm pivotally attached to the base, and a secondary arm pivotally attached to the primary arm, so that the primary and secondary arms move along axes located in a plane parallel to the tubing face of the heat exchanger. Furthermore, the articulated arm assembly includes a lance transport mechanism attached to the secondary arm and the lance, and that translates perpendicular to the tubing face toward and away from the tubing face, thereby adjusting the position of the lance toward or away from the tubing face.

The present invention also provides a method of cleaning tubes in a heat exchanger. The method includes the step of mounting a lance to an articulated arm assembly having primary and secondary arms and a lance transport mechanism. The primary and secondary arms are attached to the heat exchanger and positioned to move the lance along axes in a plane parallel to a tube face of the heat exchanger. The lance transport mechanism is positioned to translate the lance perpendicular to the tubing face toward and away from the tubing face. The method further includes the steps of moving the lance with the articulated arm assembly until the lance is substantially aligned with the axis of a predetermined tube in the heat exchanger, moving the lance toward the predetermined tube in a direction perpendicular to the tube face, and ejecting water from the lance to clean the predetermined tube in the heat exchanger.

DETAILED DESCRIPTION OF THE PREFERRED EMBODIMENTS

Figure 1:
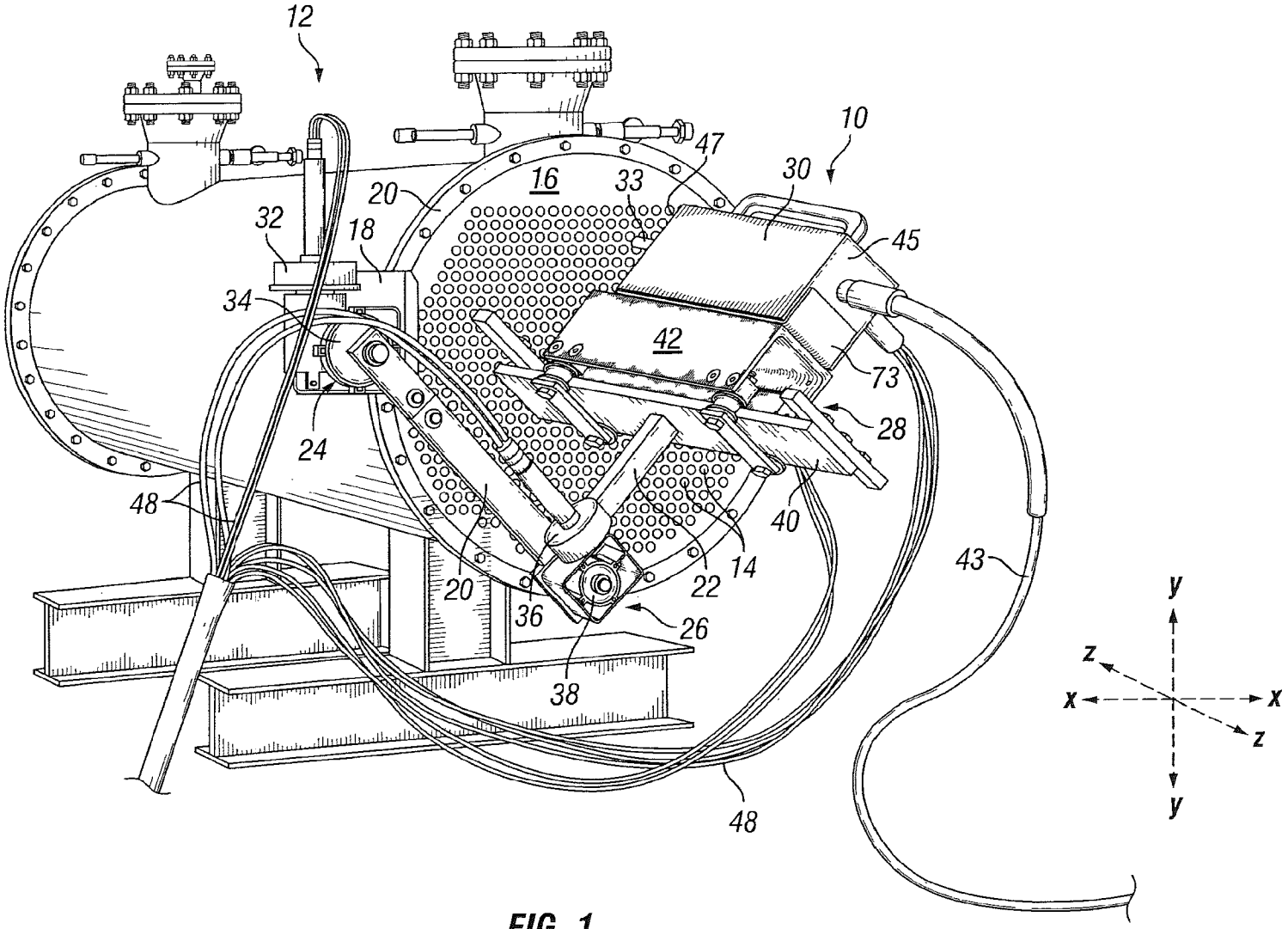
FIG. 1 is an isometric view of a tool for cleaning tubes in a heat exchanger according to an embodiment of the present invention.

In FIG. 1, there is depicted a heat exchanger tube cleaning tool 10 according to the present invention for cleaning a conventional heat exchanger 12. Typically, a heat exchanger 12 includes a plurality of tubes 14 that terminate at a tube face 16. The tube face 16 is typically planar, and oriented vertically when the heat exchanger 12 is positioned as intended on flat ground. Each of the tubes 14 is open at the tube face 16, and extends longitudinally through the heat exchanger 12. Over time, the tubes 14 may become dirty, or may accumulate contaminates that limit the flow of fluid through the tubes 14. Accordingly, it advantageous to clean the tubes periodically to enable efficient operation of the heat exchanger 12.

Cleaning of the heat exchanger tubes 14 may be accomplished using the heat exchanger tube cleaning tool 10 shown in FIG. 1. The heat exchanger tube cleaning tool 10 includes a base 18 configured for attachment to a flange 20 of the heat exchanger 12 adjacent the tubing face 16. The base 18 can be fixedly attached to the heat exchanger 12. The cleaning tool 10 also includes a primary arm 20 and a secondary arm 22. As shown, the primary arm 20 is attached to the base at a first articulating joint 24. Similarly, the secondary arm 22 is attached to the primary arm 20 at a second articulated joint 26. A lance transport mechanism 28 is attached to an end of the secondary arm 22, and may be configured to carry a lance feeder 30. The lance feeder is fixedly attached to the lance transport mechanism 28 and travels together with the moveable member 42 thereof.

The arrangement of primary and secondary arms 20, 22, as well as the first and second articulated joints 24, 26, provides the cleaning tool 10 the ability to move the lance feeder along X and Y axes in a plane substantially parallel to the tubing face 16 of the heat exchanger 12. To accomplish this movement, the first articulated joint 20 is equipped with a first air motor 32 and a gear box 34. Similarly, the second articulated joint 22 is equipped with a second air motor 36 and a second gear box 38. Although some embodiments employ air motors 32, 36, it is to be understood that any kind of motor could be used, including, for example, a hydraulic or electric motor. The first and second air motors 32, 36 drive the movement of the primary and secondary arms 20, 22, respectively, and the first and second gear boxes 36, 38 control the movement of the arms 20, 22. Thus, a suitable nozzle (not shown) at a distal end of a flex lance 33 attached to the lance feeder can be moved from one position to another relative to the tubing face 16, and can be axially aligned with any tube 14 in the heat exchanger 12 to direct water or other cleaning solution into each tube 14.

As discussed above, the lance transport mechanism 28 is typically mounted near the end of the secondary arm 22. As described in greater detail below, the lance transport mechanism 28 includes a support member 40 that is typically fixed relative to the secondary arm 22, and a movable member 42 that is slidably attached to the support member 40 along a Z axis that is perpendicular to the tubing face 16 and the plane in which the primary and secondary arms 20, 22 move. Accordingly, the lance transport mechanism 28 is capable of moving the flex lance 33 toward or away from the tubing face. In some embodiments, the lance transport mechanism 28 is capable of up to 12 inches or more of movement toward or away from the tubing face 16. One advantage of cleaning toot 10, which has both primary and secondary arms 20, 22, as well as the lance transport mechanism 28, is that such a cleaning tool allows movement of the flex lance 33 or nozzle along three axes. This allows not only axial alignment of the flex lance 33 with each tube 14, but also the ability to move the flex lance 33 toward each tube 14 and even into each tube 14 to ensure that water exiting the flex lance 33 is appropriately directed inside the tubes 14.

With the moveable member 42 in the forward position toward the tubing face 16, the flex lance 33 is positioned near or inside a tube 14. Thereafter, in some embodiments, the lance feeder 30 may be activated to drive the flex lance 33 through the tube from the tubing face 16 toward the opposite end of the heat exchanger 12. To accomplish this, the flex lance 33 is attached to a water line 43, and extends through the lance feeder from the back end 45 of the lance feeder to the front 47. A drive mechanism (not shown) inside the lance feeder 30 drives the flex lance 33 through the lance feeder 30 toward the tubing face 16, thereby pushing the flex lance 33 into the a tube 14. The lance feeder 30 may continue driving the flex lance 33 into the tube 14 until the flex lance 33 reaches a desired depth, which may be the back end of the heat exchanger 12. Thereafter, the lance feeder 30 is configured to retract the flex lance 33 until the flex lance 33 exits the tube 14. The cleaning tool 10 is then repositioned until the flex lance 33 is adjacent a new tube 14, and the process is repeated until a sufficient number of tubes 14 have been cleaned and the heat exchanger 12 reaches a desired level of cleanliness. The flex lance 33 may have an inner diameter of up to ⅜ on an inch, or 9 mm, and may have a pressure rating of up to 40,000 pounds per square inch or more.

In other embodiments, a flex lance 33 does not enter the tubes 14. Instead, a nozzle is positioned adjacent the tubing face 16 and blasts water into the tube 14. This approach may be commonly referred to as the "shotgun" cleaning approach.

Figure 2:
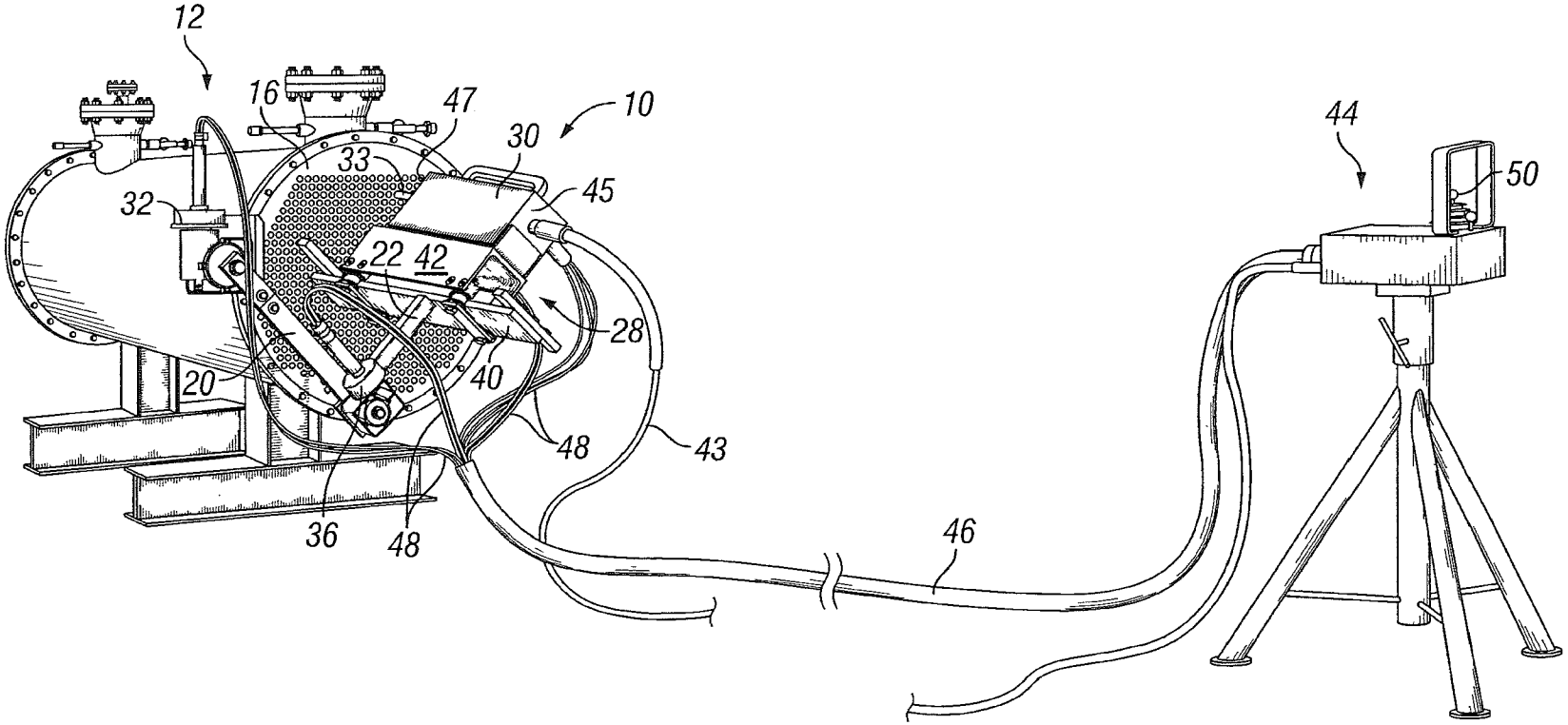
FIG. 2 is an isometric view of the tool of FIG. 1, and further showing a control unit for controlling the tool.

Referring to FIG. 2, there is shown the heat exchanger 12 and cleaning tool 10 of the present technology, along with a control unit 44. The control unit 44 is attached to the cleaning tool 10 by an umbilical 46. In some embodiments, the umbilical may be up to 15 to 25 feet in length or more, although any length of umbilical may be used. The umbilical 46 includes wire and/or fluid lines 48 for controlling the air motors 32, 36, as well as the lance feeder 30. Use of an umbilical 46 such as that shown in FIG. 2 is advantageous because it allows an operator to control the cleaning tool 10 from a safe distance. This may be beneficial because the water used to clean the tubes 14 may exit the flex lance 33 or nozzle at high speed, thereby posing a risk of injury to the operator if proper distance is not maintained. By removing the operator from the immediate vicinity of the heat exchanger during cleaning, safety is increased, worker fatigue is reduced, visibility of the operator is increased, and a more controlled and consistent cleaning pattern is achieved. The control unit 44 may include any appropriate controls, such as, for example, one or more joy stick type controllers 50, the movements of which correlate to movements of the cleaning tool 10.

Figure 3:
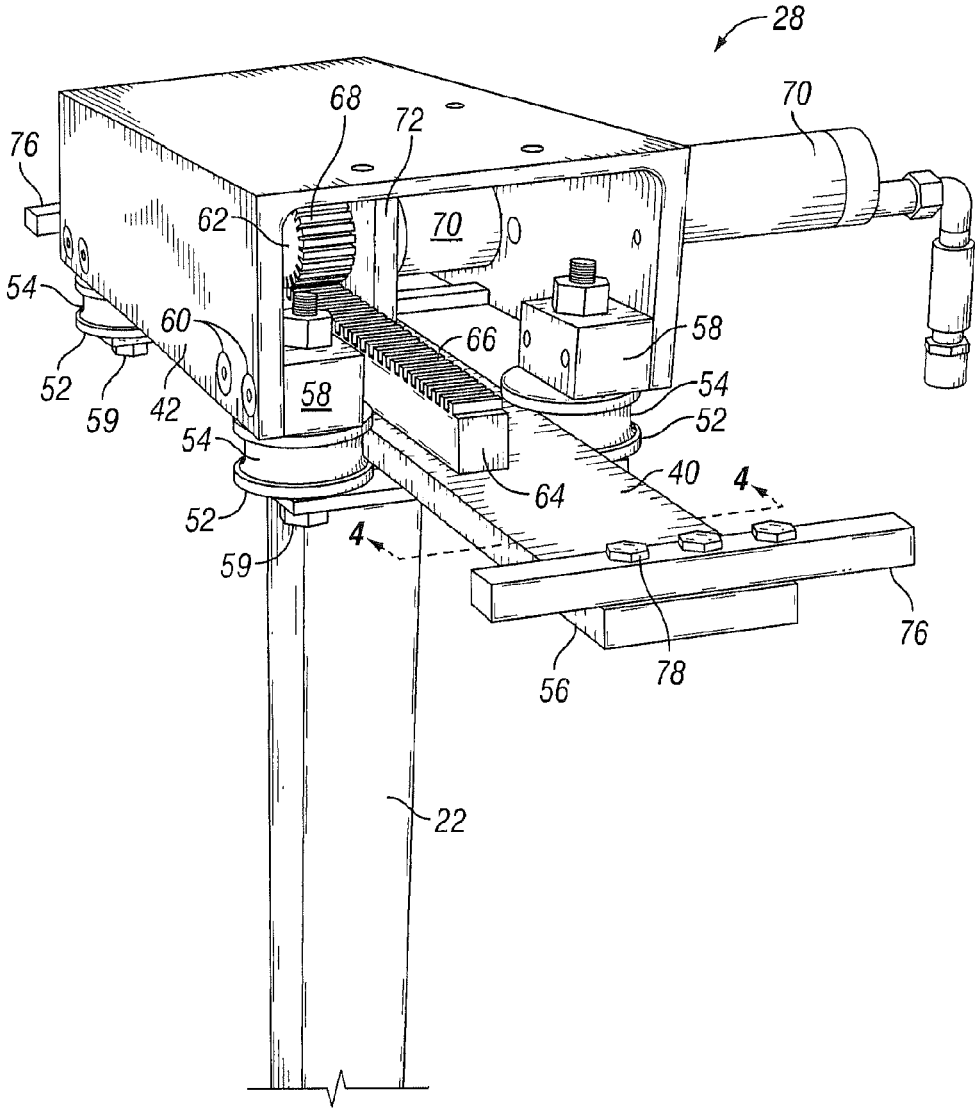
FIG. 3 is an enlarged isometric view of a lance transport mechanism according to an embodiment of the present invention.

Referring now to FIG. 3, there is shown an enlarged view of the lance transport mechanism 28, including the support member 40 and the moveable member 42. As discussed above, the support member 40 is fixedly attached to the secondary arm 22. The moveable member 42 can be guided by rollers 52 circumscribed by recesses 54 that correspond to the sides 56 of the support members. The rollers 52 may be attached to the moveable member 42 by any appropriate means. In the embodiment shown, for example, blocks 58 are attached to the moveable member 42 with fasteners 60. The rollers 52 are in turn attached to the blocks 58 by fasteners 59. In alternate embodiments, blocks 58 may be integrally formed with the moveable member 42. The rollers 52 may be made from any suitable material, such as, for example, ultra high molecular weight polyethylene (UHMW) plastic.

In the embodiment shown in FIG. 3, the moveable member 42 may be driven relative to the support member 40 by a drive gear 62 and rack 64. The rack 64 is fixedly attached to the support member 40 with rack teeth 66 oriented upward away from the support member 40. The drive gear 62 has gear teeth 68 configured to correspond to the rack teeth 66. The drive gear 62 is attached to an air motor 70 via a shaft 71 (shown in FIG. 4). Although the motor 70 shown in the drawing is an air motor, it is to be understood that any suitable type of motor may be used, such as, for example, hydraulic or electric motors. The shaft passes through a gear support 72 that serves to position the drive gear 62 relative to the moveable member 42. In addition, the gear support 72 positions the drive gear 62 so that the gear teeth 68 engage the rack teeth 66.

In practice, the drive gear 62 is powered by the air motor 70 so that it turns. The air motor is connected via fluid lines 48 to the control unit 44. As the drive gear 62 turns, the gear teeth 68 interact with the rack teeth 66 to move the drive gear 62 relative to the rack 64. This movement of the drive gear 62 in turn moves the moveable member 42 relative to the support member 40. As the moveable member 42 moves, the rollers 52 maintain the alignment of the moveable member 42 with the support member 40 so that the moveable member 42 moves perpendicularly toward and away from the tubing face 16 (shown in FIG. 1). In addition, the support member 40 may include stop plates 76 that limit movement of the moveable member 42 relative to the support member 40. The stop plates 76 may be attached to the support member 40 using fasteners 78. Alternatively, the stop plates 76 may be integrally formed with the support member 40.

Figure 4:
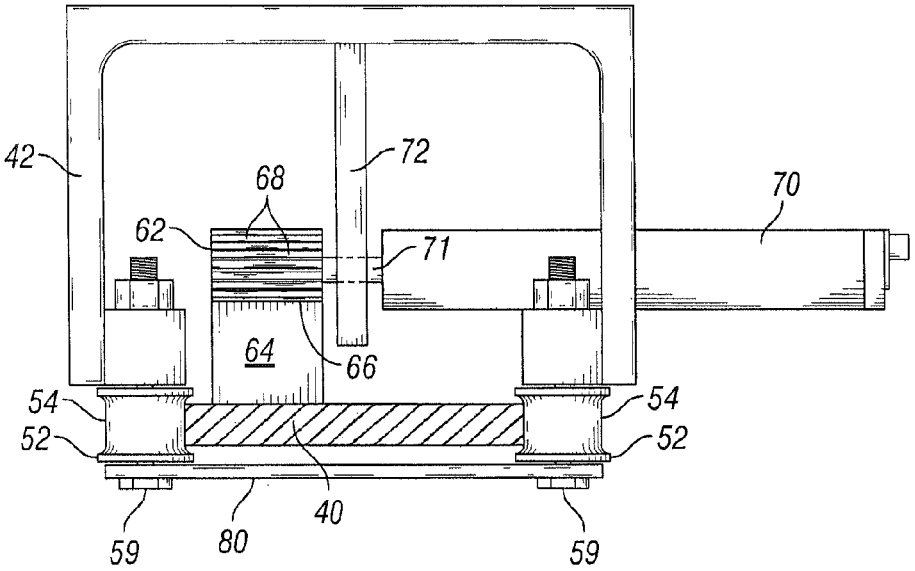
FIG. 4 is an enlarged cross-sectional side view of the lance transport mechanism of FIG. 3 taken along line 4-4.

FIG. 4 shows a cross sectional view of the lance transport mechanism 28, taken along line 4-4 of FIG. 3. In this view, the shaft 71 that connects the drive gear 62 to the air motor 70 is clearly shown. In addition, there is also shown a bracket 80 connecting the rollers 52 on opposite sides of the support member 40. Bracket 80 may serve to help maintain the relative positions of the rollers 52, and to ensure that the moveable member 42 does not lift off of the support member 40.

Figure 5:
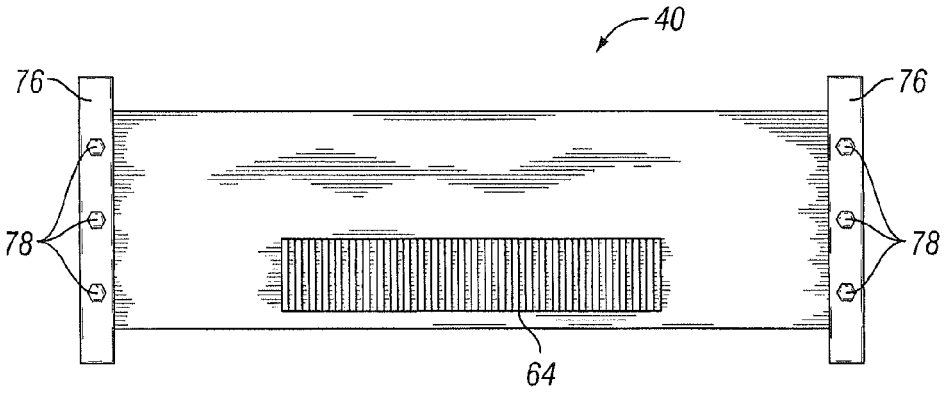
FIG. 5 is an enlarged top view of a supporting mechanism of the lance transport mechanism shown in FIG. 3.
Figure 6:
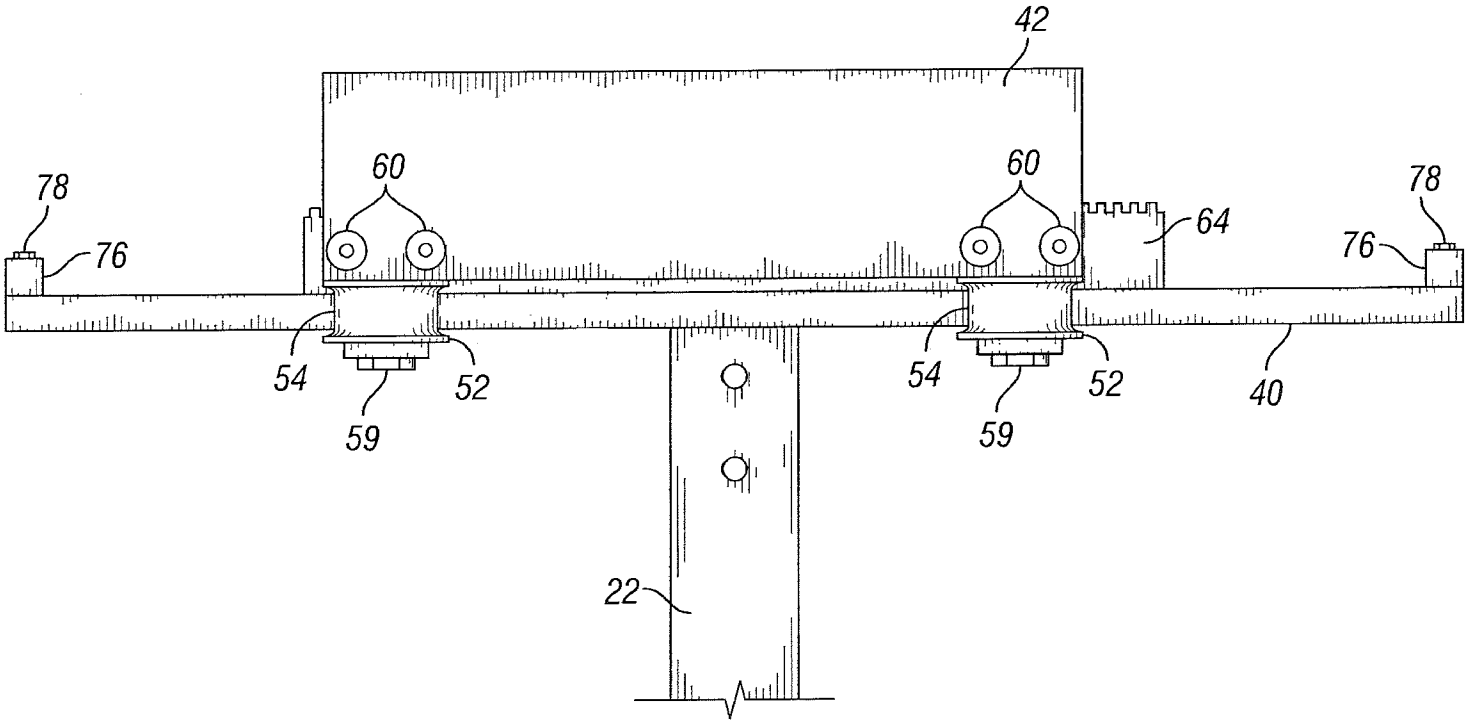
FIG. 6 is an enlarged side view of the lance transport mechanism shown in FIG. 3.

FIG. 5 shows a top view of the support member 40 with the moveable member 42 removed. Specifically, there is depicted the rack 64, stop plates 76, and stop plate fasteners 78. FIG. 6 similarly shows a side view of the lance transport mechanism 28 as discussed above. In particular, FIG. 6 shows the support member 40, moveable member 42, rollers 52 with recesses 54, fasteners 59, 60, rack 64, stop plates 76, stop plate fasteners 78, and secondary arm 22.

The invention has been sufficiently described so that a person with average knowledge in the matter may reproduce and obtain the results mentioned in the invention herein Nonetheless, any skilled person in the field of technique, subject of the invention herein, may carry out modifications not described in the request herein, to apply these modifications to a determined structure, or in the manufacturing process of the same, requires the claimed matter in the following claims; such structures shall be covered within the scope of the invention.

It should be noted and understood that there can be improvements and modifications made of the present invention described in detail above without departing from the spirit or scope of the invention as set forth in the accompanying claims.

What is claimed is:

1. A tool for cleaning a heat exchanger having tubes and a tube face, the tool comprising:

a lance;

an articulated arm fixedly attached to the heat exchanger at a first end, and associated with the lance at a second end, the articulated arm having at least two joints so that the articulated arm can move the lance along two axes in a plane substantially parallel to the tube face of the heat exchanger; and a lance transport mechanism attached to the second end of the articulated arm that moves toward and away from the tube face of the heat exchanger in a direction substantially perpendicular to the tube face, the lance transport mechanism attached to the lance so that the lance moves toward and away from the tube face along with the lance transport mechanism, the lance transport mechanism comprising:

a support member fixedly attached to the second end of the articulated arm, and a moveable member slidingly attached to the support member that moves relative to the support member toward and away from the tubing face.

2. The tool of claim 1, wherein the support member has a stop plate that limits the movement of the moveable member relative to the support member.

3. The tool of claim 1, wherein the moveable member has rollers that engage the support member to maintain alignment between the moveable member and the support member.

4. The tool of claim 1, wherein the lance transport mechanism further comprises:

a rack attached to the support member; and a drive gear attached to the moveable member, the drive gear engaging the rack so that when the drive gear turns the moveable member translates relative to the support member.

5. The tool of claim 4, wherein the lance transport mechanism further comprises:

a support member attached to the moveable member for supporting the drive gear.

6. The tool of claim 1, wherein the lance transport mechanism has a female dovetail bracket, the tool further comprising:

a lance feeder fixedly attached to the female dovetail bracket so that the lance feeder moves with the lance transport mechanism.

7. The tool of claim 1, wherein the lance has a pressure rating of up to 40,000 pounds.

8. The tool of claim 1, further comprising:

a control unit having an umbilical attached to the articulated arm and the lance transport mechanism for controlling the articulated arm and the lance transport mechanism.

9. A heat exchanger cleaning apparatus, comprising:

an articulated arm assembly having a lance attached thereto, the articulated arm assembly comprising:

a base fixedly attached to a heat exchanger having a tubing face;

a primary arm pivotally attached to the base;

a secondary arm pivotally attached to the primary arm, so that the primary and secondary arms move along axes located in a plane parallel to the tubing face of the heat exchanger; and a lance transport mechanism attached to the secondary arm and the lance, and that translates perpendicular to the tubing face toward and away from the tubing face, thereby adjusting the position of the lance toward or away from the tubing face, the lance transport mechanism comprising:

a support member fixedly attached to the secondary arm, and a moveable member slidingly attached to the support member that moves relative to the support member toward and away from the tubing face.

10. The heat exchanger cleaning apparatus of claim 9, wherein the support member has a stop plate that limits the movement of the moveable member relative to the support member.

11. The heat exchanger cleaning apparatus of claim 9, wherein the moveable member has rollers that engage the support member to maintain alignment between the moveable member and the support member.

12. The heat exchanger cleaning apparatus of claim 9, wherein the lance transport mechanism further comprises:

a rack attached to the support member; and a drive gear attached to the moveable member, the drive gear engaging the rack so that when the drive gear turns the moveable member translates relative to the support member.

13. The heat exchanger cleaning apparatus of claim 12, wherein the lance transport mechanism further comprises:

a support member attached to the moveable member for supporting the drive gear.

14. The heat exchanger cleaning apparatus of claim 9, wherein the lance transport mechanism has a female dovetail bracket, the heat exchanger cleaning apparatus further comprising:

a lance feeder fixedly attached to the female dovetail bracket so that the lance feeder moves with the lance transport mechanism.

15. The heat exchanger cleaning apparatus of claim 9, further comprising:

a control unit having an umbilical attached to the primary arm, the secondary arm, and the lance transport mechanism for controlling the primary arm, the secondary arm, and the lance transport mechanism.

* * * * *